US007156786B1

(12) United States Patent
Palmer

(10) Patent No.: US 7,156,786 B1
(45) Date of Patent: Jan. 2, 2007

(54) DEVICE FOR EXERCISING ONE'S THIGHS AND BUTTOCKS

(76) Inventor: Dennis D Palmer, 1169 Lone Peak La., Draper, UT (US) 84060

( * ) Notice: Subject to any disclaimer, the term of this patent is extended or adjusted under 35 U.S.C. 154(b) by 0 days.

(21) Appl. No.: 09/089,722

(22) Filed: Jun. 3, 1998

(51) Int. Cl.
*A63H 1/02* (2006.01)

(52) U.S. Cl. ..... 482/132; 482/907; 482/51

(58) Field of Classification Search ..... 482/907, 482/147, 71, 146, 132, 51, 54, 142, 56; 434/255; 601/23, 33
See application file for complete search history.

(56) References Cited

U.S. PATENT DOCUMENTS 3,529,818 A * 9/1970 Aijala
3,531,110 A * 9/1970 Marcho
3,650,528 A * 3/1972 Natterer
3,791,645 A * 2/1974 Stelma
3,807,727 A * 4/1974 Ferguson
4,607,839 A * 8/1986 Knudson
4,799,475 A * 1/1989 Iams
4,993,704 A * 2/1991 Luczynski
5,316,530 A * 5/1994 Romer
5,407,406 A * 4/1995 Canela ..... 482/51
5,588,841 A * 12/1996 Mechling ..... 434/255
5,607,374 A * 3/1997 Hesse ..... 482/51
5,749,811 A * 5/1998 Wilson ..... 482/71

* cited by examiner

*Primary Examiner*—Jerome W. Donnelly
(74) *Attorney, Agent, or Firm*—Geoffrey E. Dobbin

(57) ABSTRACT

An exercising device upon which one kneels and can exercise one's thighs and buttocks by pushing one's knees away from each other in a direction substantially parallel with a line through one's hip joints has a pair of longitudinal swing arms that are pivotally mounted at first ends thereof to a respective, upwardly extending, spaced apart pivot axes. The swing arms extend generally laterally outwardly from the respective pivot axes and can pivot about the respective pivot axes from a first position in which the swing arms are substantially parallel with each other to a second position in which distal ends of the swing arms diverge outwardly from each other so that the swing arms form an acute angle with each other. Supports are provided on the swing arms for accommodating knees of a user of the machine in a position adjacent respective distal ends of the swing arms, with the shins of the user lying adjacent respective swing arms so that the user can kneel on the supports and can move his or her knees in reciprocating motion away from and back toward each other in a direction such that a line through the knees of the user is substantially parallel with a line through the hip joints of the user.

6 Claims, 1 Drawing Sheet

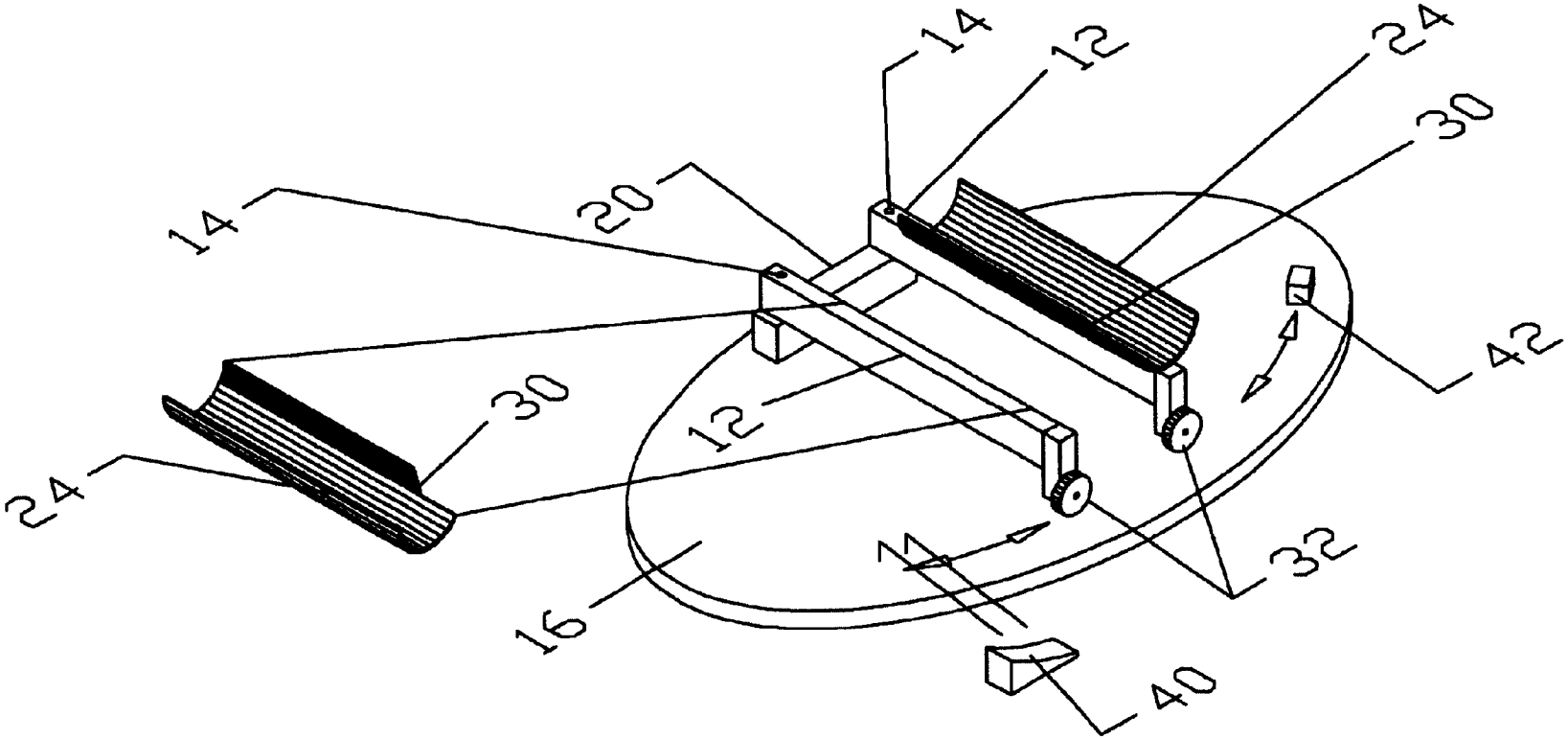
24
30
22
32
40
21
14
12
20
16
30
14
22

DEVICE FOR EXERCISING ONE'S THIGHS AND BUTTOCKS

BACKGROUND OF THE INVENTION

1. Field

The present invention relates to devices which are used to exercise one's thighs and buttocks. In particular, the invention relates to such devices upon which the user can kneel and push the user's knees in reciprocating motion away from each other and back toward each other in a direction substantially parallel with a line through one's hip joints.

2. State of the Art

Exercising apparatus is known wherein the user stands on foot platforms, and the foot platforms can be moved back and forward in a motion simulating cross country skiing. It has also been suggested that the user stand on the foot platforms and move the user's feet away from each other and back toward each other in a direction along a line through the hips of the user. There has been no suggestion of an exercising device in which the user kneels on a pair of pivoting leg supports, wherein the knees of the user can be moved in a reciprocating movement outwardly from the hips of the user in a direction substantially parallel with a line through one's hip joints.

It has been found that it would be highly desirable to provide an inexpensive, improved device upon which one can kneel and exercise the user's thighs and buttocks by pushing the user's knees first away from each other and then back toward each other in a direction substantially parallel with a line through one's hip joints.

OBJECTS AND SUMMARY OF THE INVENTION

A principal objective of the present invention is to provide an inexpensive device which is easily and readily used in exercising the thighs and buttocks of the user.

A particular objective of the present invention is to provide an exercising device having a pair of elongate leg support members upon which the user kneels, with the leg support members being pivotally mounted about respective first ends so that when the user positions his or her knees adjacent to the respective second ends of the support members, the user can push his or her knees outwardly from the side of the user's body in a direction that is substantially parallel with a line through the user's hips while the knees of the user move in an arcuate path defined by the pivoting movement of the leg support members.

The above objectives are achieved in accordance with the present invention by providing a novel exercising device upon which one kneels and can exercise one's thighs and buttocks by pushing one's knees away from each other in a direction substantially parallel with a line through one's hip joints. The novel exercising device of the present invention has a pair of longitudinal swing arms, with respective first ends of the swing arms being mounted to a pair of upwardly extending, spaced apart pivot axes so that the swing arms extend generally laterally outwardly from the respective pivot axes and can pivot about the respective pivot axes from a first position in which the swing arms are substantially parallel with each other to a second position in which distal, second ends of the swing arms diverge outwardly from each other so that said swing arms form an acute angle with each other. In a preferred embodiment of the exercising apparatus of the present invention, a pair of elongate leg support members are mounted on respective longitudinal swing arms. The respective elongate leg support members accommodates the knees and shins of respective legs of a user of the machine. The user kneels on the support members pushes his or her knees in reciprocating motion away from and back toward each other in a direction substantially parallel with a line through the hip joints of the user. The knees of the user further move in an arcuate motion defined by the path of the distal ends of the pivoting swing arms.

Additional objects and features of the invention will become apparent from the following detailed description, taken together with the accompanying drawings.

THE DRAWINGS

A preferred embodiment of the present invention representing the best mode presently contemplated of carrying out the invention is illustrated in the single FIGURE of the accompanying drawing, wherein said FIGURE is a pictorial representation of the exercising device of the present invention.

DETAILED DESCRIPTION OF THE ILLUSTRATED EMBODIMENTS

An exercising device in accordance with the present invention is shown in the drawing. The device is used to exercise a person's thighs and buttocks by kneeling on the device and pushing one's knees away from each other in a direction substantially parallel with a line through one's hip joints.

The device comprises a pair of longitudinal swing arms 12. A pair of upwardly extending, spaced apart pivot axes 14 are provided, and first ends of the swing arms 12 are pivotally mounted to respective pivot axes 14 in a manner so that the swing arms 12 extend generally laterally outwardly from the respective pivot axes 14. Further, the swing arms 12 can pivot about the respective pivot axes 14 from a first position in which the swing arms 12 are substantially parallel with each other to a second position in which distal, second ends of the swing arms 12 diverge outwardly from each other so that the swing arms 12 form an acute angle with each other.

In the illustrated embodiment, a substantially flat base platform 16 is provided having a substantially flat upper surface. The flat base platform 16 is adapted to be supported on a firm support such as a floor or deck. Means are provided for mounting the pivot axis 14 to the flat base platform 16 so that the swing arms 12 are suspended above the upper surface of the flat base platform 16. Preferably, the swing arms 12 are mounted so that they pivot about their respective first ends in a plane that is substantially parallel with the upper surface of the flat base platform 16.

As illustrated, a mounting block 20 is attached to the upper surface of the platform 16 at a position near a side edge of the platform 16. The pivot axes 14 are formed by two spaced apart rods that extend upwardly from the mounting blocks 20. The first ends of the swing arms 12 are provided with bushing bearings that pivot on the pivot axes 14. The first ends of the swing arms 12 are also supported by the mounting block 20, and the first ends of the swing arms 12 make sliding, pivotal movement over the upper surface of the mounting blocks 20.

Means are associated with the swing arms 12 to accommodate the knees and shins of a user of the machine. The user's knees are positioned adjacent respective second ends of the swing arms 12, and the shins of the user lie adjacent respective swing arms 12 so that the user can kneel on the means for accommodating the user's knees and can move the user's knees in reciprocating motion away from and back toward each other in a direction such that a line through the knees of the user is substantially parallel with a line through the hip joints of the user.

It is emphasized that the user pushes his or her knees in opposite directions from the opposite sides of the user's body. This pushing is directed in a line that is substantially parallel with a line through the hip joints of the user. The actual movement of the user's knees follows an arcuate path defined by the radius of curvature of the swing arms 12, but the user continuously pushes his or her knees outwardly away from the user's hips in a direction that is parallel with a line through the hip joints of the user.

In the preferred embodiment of the exercising device as illustrated, the means for accommodating the user's knees and shins comprises a pair of elongate leg support members 24. Each leg support member 24 is mounted on a respective longitudinal swing arm 12. The elongate leg support members 24 are adapted to receive the knees and shins of respective legs of a user of the device when the user kneels on the leg support members 24. Advantageously, each elongate leg support member 24 has a curved upper surface that forms a smooth, elongate trough in which the shins of the user are received. In addition, it is advantageous to form notches 30 in forward sides of the elongate leg support members 24 that face each other. The notches 30 allow the knee of the user to pivot back and forth without engaging the curved sides of the elongate leg support members 24.

In the preferred embodiment of the device of the present invention as illustrated, a wheel 32 is mounted at a distal end of each of the swing arms 24 so that the wheel 32 on each swing arm contacts and rolls along the upper surface of the flat base platform 16. An inclined ramp 40 and/or a stop block 42 can be situated on the upper surface of the base platform 16. When a pair of inclined ramps 40 are positioned on the platform 16, the wheels 32 ride up on the inclined ramps 40 to provide resistance. The user must push harder with his or here knees to push the wheels 32 up the ramps 40. The stop blocks 42 are used to provide an abutment which stops the wheels 32 from further outward movement.

Although preferred embodiments of the exercise device of the present invention has been illustrated and described, it is to be understood that the present disclosure is made by way of example and that various other embodiments are possible without departing from the subject matter coming within the scope of the following claims, which subject matter is regarded as the invention.

What is claimed is:

1. An exercising device upon which one kneels and can exercise one's thighs and buttocks by pushing one's knees away from each other in a direction substantially parallel with a line through one's hip joints, said device comprising:

a. a pair of longitudinal swing arms having respective first and second ends;

b. a pair of upwardly extending, spaced apart pivot axes;

c. means for pivotally mounting each of said first ends of said swing arms to respective pivot axes so that the swing arms extend generally laterally outwardly from the respective pivot axes and can pivot about said respective pivot axes from a first position in which said swing arms are substantially parallel with each other to a second position in which said second ends of said swing arms diverge outwardly from each other so that said swing arms form an acute angle with each other; and d. a pair of elongate leg support members, each leg support member having two substantially parallel elongate edges and being mounted on a respective longitudinal swing arm in a manner rigidly fixed with respect to said respective longitudinal swing arm, said elongate leg support members having a curved upper surface, the curved upper surface defining curved sides and an axis substantially parallel to the elongate edges, thereby forming a smooth, elongate trough in which shins of the user are received;

wherein, the knees of a user of the machine are accommodated in a position adjacent respective second ends of said swing arms, with the shins of the user lying adjacent respective swing arms so that the user can kneel on said leg support members and can move the user's knees in reciprocating motion away from and back toward each other in a direction such that a line through the knees of the user is substantially parallel with a line through the hip joints of the user.

2. An exercising device in accordance with claim 1 wherein notches are formed in forward sides of said elongate leg support members that face each other, wherein said notches allow the knee of the user to pivot back and forth without engaging the curved sides of said elongate leg support members.

3. An exercising device in accordance with claim 1 further comprising:

a. a substantially flat base platform having a substantially flat upper surface, said flat base platform being adapted to be supported on a firm support such as a floor or deck; and b. means for mounting said pair of pivot axes to said base platform at spaced apart positions near a side edge of said base platform so that the swing arms are suspended above said base platform.

4. An exercising device in accordance with claim 3 wherein notches are formed in forward sides of said elongate leg support members that face each other, wherein said notches allow the knee of the user to pivot back and forth without engaging the curved sides of said elongate leg support members.

5. An exercising device in accordance with claim 3 wherein a wheel is mounted at a distal end of each of said swing arms so that the wheel on each swing arm contacts and rolls along said upper surface of said flat base platform.

6. An exercising device in accordance with claim 3 wherein notches are formed in forward sides of said elongate support members that face each other, wherein said notches allow the knee of the user to pivot back and forth without engaging the curved sides of said elongate leg support members.

* * * * *